United States Patent [19]

Ishii et al.

[11] Patent Number: 4,860,651

[45] Date of Patent: Aug. 29, 1989

[54] SKEW CORRECTING APPARATUS FOR MULTI-COLOR PRINTING MACHINE

[75] Inventors: Koji Ishii, Fuchu; Yukito Okuda, Tokyo, both of Japan

[73] Assignee: Ryobi Ltd., Hiroshima, Japan

[21] Appl. No.: 269,846

[22] Filed: Nov. 10, 1988

[30] Foreign Application Priority Data

Nov. 13, 1987 [JP] Japan ..... 62-174175[U]

[51] Int. Cl.[4] ..... B41F 5/18

[52] U.S. Cl. ..... 101/232; 101/409; 101/177

[58] Field of Search ..... 101/232, 409, 410, 411, 101/248, 177, 183, 246; 271/251; 226/180

[56] References Cited

U.S. PATENT DOCUMENTS 4,671,176 6/1987 Domoto et al. ..... 101/177

*Primary Examiner*—J. Reed Fisher

*Attorney, Agent, or Firm*—Sughrue, Mion, Zinn, Macpeak and Seas

[57] ABSTRACT

In a multi-color printing machine, a skew or slant of a picture to be printed is corrected by cocking, namely, swinging a paper-feed cylinder relative to a base impression cylinder by a unique but simple cocking mechanisms. The cocking mechanism includes a shaft holder which holds one end portion of the shaft of the paper-feed cylinder and which is pivotable about an eccentric position disposed on an imaginary line extending between central axes of the paper-feed cylinder and the base impression cylinder. The shaft holder is connected at another end thereof to an operating shaft via screw means which converts rotation of the operating shaft into the pivotal movement of the shaft holder.

9 Claims, 3 Drawing Sheets

1
1a
1b
1c
1d
1e
2
2a
2b
2c
2d
2e
3
3a
3a'
30
30'
4
4A
5
6
6a
6b
7
8
9
10
11
12
13
a
a'
l

SKEW CORRECTING APPARATUS FOR MULTI-COLOR PRINTING MACHINE

BACKGROUND OF THE INVENTION

The present invention relates to a multi-color printing machine, and more particularly, to an apparatus for correcting a skew of a picture in a multi-color offset printing machine.

Multi-color offset printing presses are generally disclosed in U.S. Pat. No. 3,384,011 and DE-OS 2,237,567.

Conventionally, various attempts have been made to correct or compensate a skew or slant of a picture to be printed, especially in a multi-color printing machine. For example, U.S. Pat. No. 4,362,098 discloses a twisting means for adjusting the relative position between a plate cylinder and an impression cylinder. With the disclosed structure, an image may be distorted and a uniform image development may not be obtainable along both longitudial and lateral directions of the imaging medium.

According to a picture adjusting device in a sheet-fed press disclosed in U.S. Pat. No. 4,777,876, a printer includes two printing sections (one for each color) and a base impression cyinder. Each printing section includes a plate cylinder, and an inked impression cylinder. These cylinders are all mounted parallel to one another. A paper-feed cylinder is provided to transfer paper sheets from a paper feeding section to the base impression cylinder for printing. The paper-feed cylinder is mounted at one end with a bearing held in an adjustable eccentric holder so that the rotation axis of the paper-feed cylinder is adjustable relative to the rotation axis of the impression cylinder. Accordingly, the printing position of the paper can be adjusted relative to both the inked impression cylinders. That is, the picture position can be adjusted merely by adjusting the eccentric holder. As a result, it becomes easy to control the alignment of two-color images printed in succession with two printers.

The picture adjusting device includes a frame, the rotatable paper-feed cylinder and the bearing means. The base impression cylinder and the plate and inked impression cylinders are rotatably supported on the frame. The rotatable paper-feed cylinder is separate from the base impression cylinder and the plate and inked impression cylinders, and is adapted for feeding the paper to the impression cylinder. The bearing means is adapted for supporting the shaft of the paper-feed cylinder at its opposite ends by the frame. At least one of the bearing means includes the eccentric holder movable in a plane substantially perpendicular to the shaft. As a result, the paper-feed cylinder has a rotation axis tiltable relative to a rotation axis of the base impression cylinder to adjust a placement of a sheet of paper fed to the base impression cylinder relative to the plate and the inked impression cylinders.

Here, the eccentric holder is angularly moved or turned by means of an operation knob for twisting the paper-feed cylinder with respect to an impression cylinder. However, according to such structure, delicate and accurate picture image adjustment cannot be achieved, since the amount of twist of the paper-feed cylinder and the amount of change in distance between the axis of the paper-feed cylinder and the axis of the impression cylinder become excessively large due to the rotational manupulation of the opreation knob.

According to a modification, a bearing is slidably received in a groove formed in the frame and can be fastened to the frame by a screw at an adjusted position via a twisting means. However. the latter apparatus also has a problem in that a fine adjustment may not be achievable.

SUMMARY OF THE INVENTION

It is therefore an object of the present invention to provide a skew correcting apparatus, for a multi-color printing machine, which apparatus is simple in construction and enables easy and highly precise compensation of any skew or slant of an image to be printed.

According to the present invention, there is provided an apparatus for correcting a skew of an output image to be printed on a paper in a multi-color printing machine, comprising: a frame; a base impression cylinder rotatably supported on the frame and having a first shaft which has a first central axis; a paper-feed cylinder for feeding the paper to the base impression cylinder, the paper-feed cylinder having a second shaft rotatably supported at opposite ends by the frame, the second shaft having a second central axis; a shaft holder for holding one end of the second shaft of the paper-feed cylinder and having first and second end portions, the shaft holder being pivotally supported to the frame at the first end portion; a pivot shaft for pivatally supporting the first end portion of the shaft holder, the pivot shaft extending from the frame and disposed on an imaginary line connecting between the axes of the first and second shafts; an operating shaft rotatably supported on the frame and operatively connected to the second end portion of the shaft holder; and means for pivoting the shaft holder about the pivot shaft in response to rotation of the operating shaft, the means being disposed between the operating shaft and at least one of the frame and the shaft holder.

Many other advantages, features and additional objects of the present invention will become manifest to those versed in the art upon making reference to the following detailed description and the accompanying drawings in which a preferred structural embodiment incorporating the principles of the present invention is shown by way of illustrative example.

DETAILED DESCRIPTION OF THE INVENTION

Figure 1:
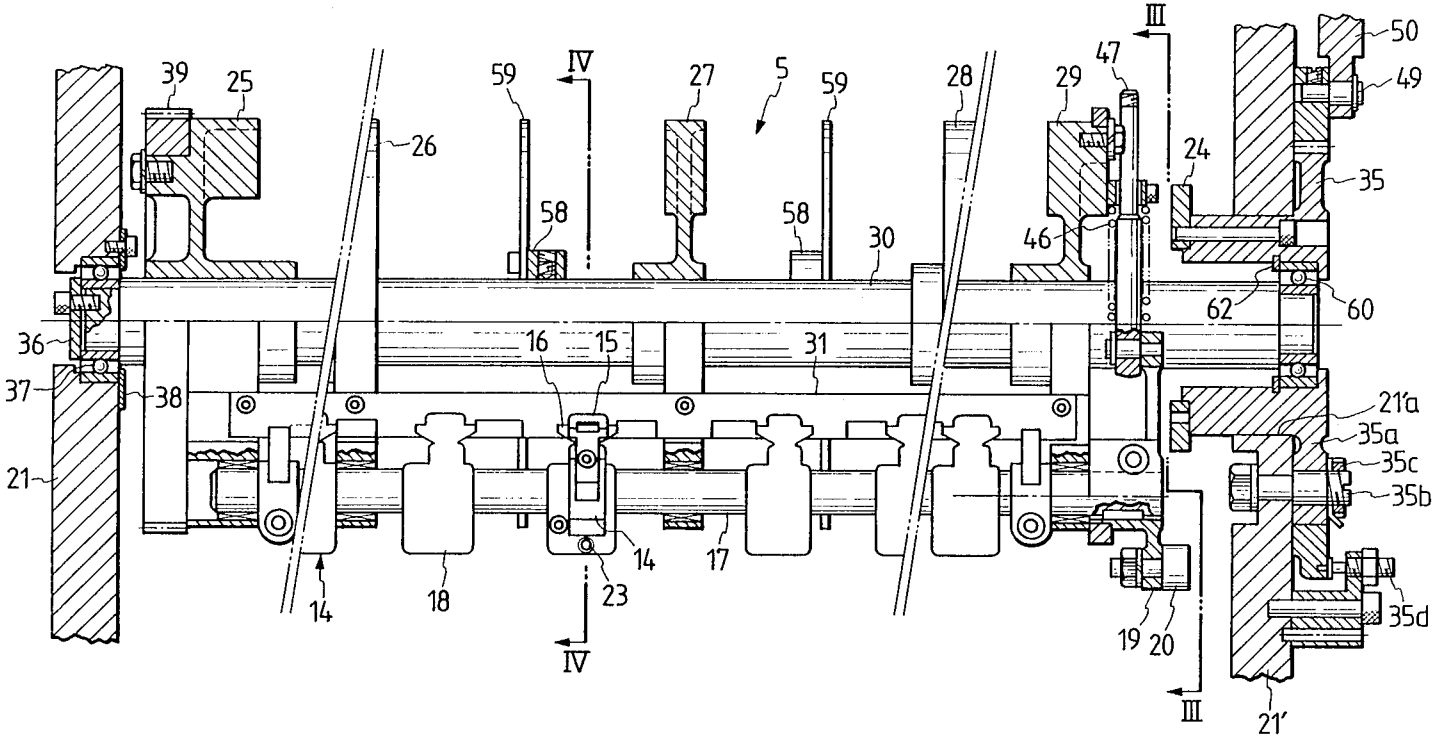
FIG. 1 is a longitudinal cross-sectional view, with parts broken away, showing a skew correcting apparatus according to the present invention.
Figure 2:
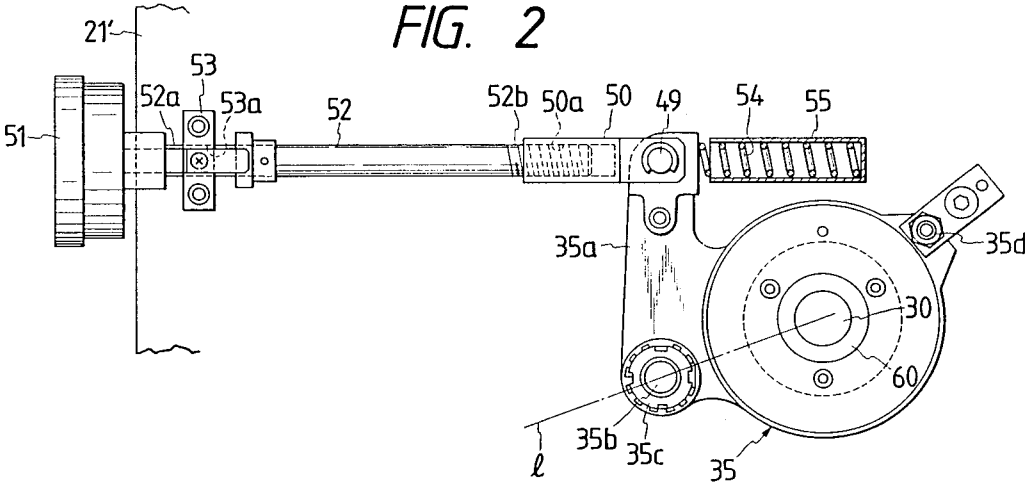
FIG. 2 is a side elevational view showing the apparatus shown in FIG. 1.

The principles of the present invention are particularly useful when embodies in a skew correcting apparatus (hereinafter simply referred to as "apparatus") such as shown in FIGS. 1 and 2.

Figures 5, 6:
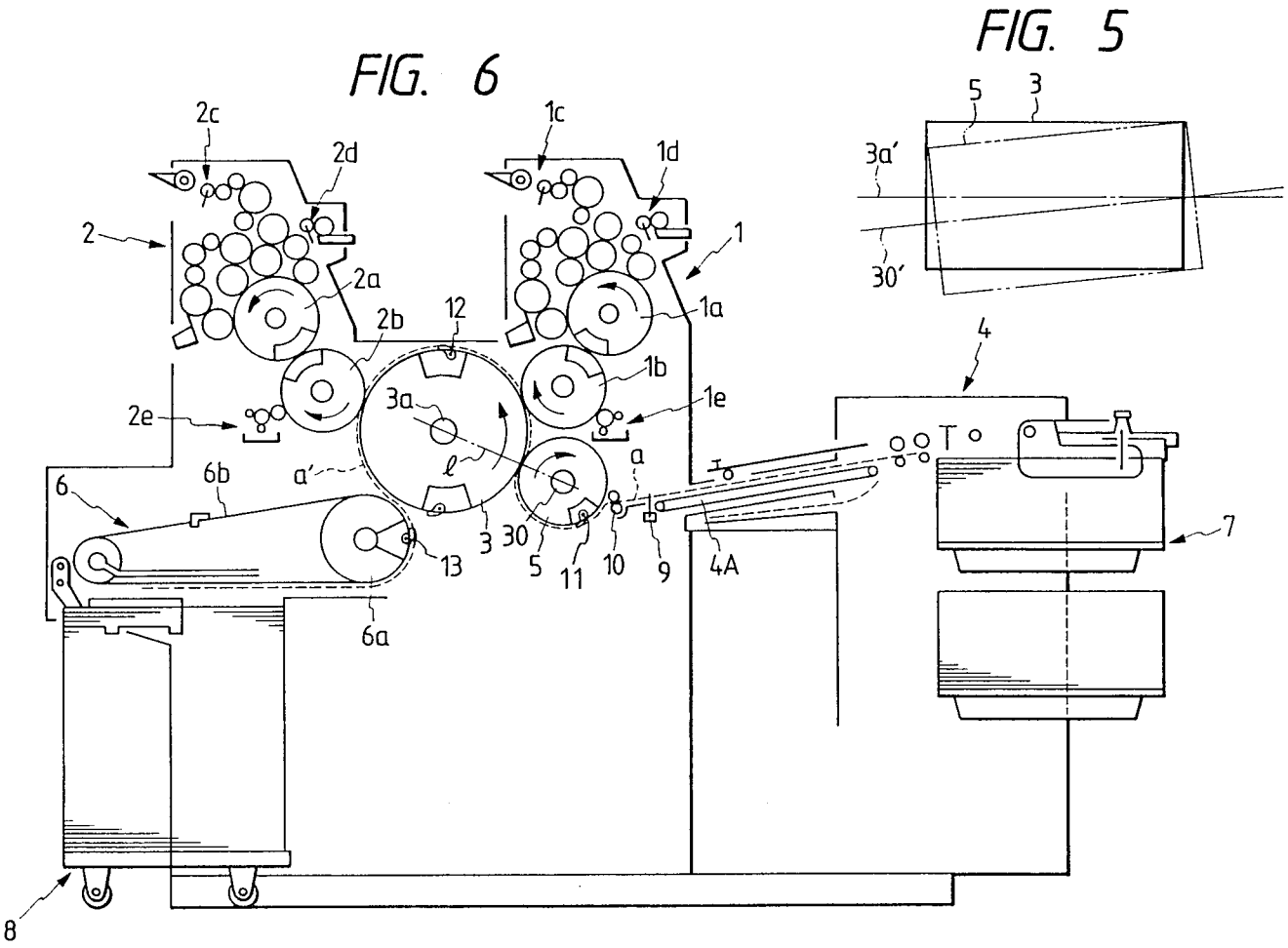
FIG. 5 is a schematic view showing the relationship between an impression cylinder and a paper-feed cylinder; and, FIG. 6 is a schematic side elevational view showing a two-color printing machine incorporating the apparatus of the present invention.

FIG. 6 illustrates a two-color offset printing machine (hereinafter simply referred to as "printing machine") incorporating the apparatus of FIGS. 1 and 2. The printing machine generally includes a first printing unit 1, a second printing unit 2, a base impression cylinder 3 serving also as a transfer drum for the second printing unit 2, a paper supply unit 4, a paper-feed cylinder 5, a paper discharge unit 6, a paper supply table 7, and a paper discharge table 8. The paper supply unit 4 includes a paper delivery means 4A, and between the paper-feed cylinder 5 and an outlet end of the paper delivery means 4A, a pair of paper insertion rollers 10 are provided. Such general structure is the same as that in U.S. Pat. No. 4,777,876.

The first and second printing units 1, and 2 have identical constructions with each other which include various corresponding cylinders having equal diameter to each other. More specifially, these units 1 and 2 are respectively composed of plate cylinders 1*a* and 2*a*, blanket cylinders 1*b* and 2*b*, ink supply sections 1*c* and 2*c*, water supply sections 1*d* and 2*d*, and blanket cleaning sections 1*e* and 2*e*.

A needle or a side guide 9 is provided at an outlet end of the paper deliery means 4A so as to align or preregistor the paper "a". Further, a first gripper 11 is provided at the paper-feed cylinder 5 of the first printing unit 1 for gripping the paper "a" in its aligned orientation fed from the paper delivery means 4A. The base impression cylinder 3 has a second gripper 12 for gripping the paper "a" fed from the paper feed cylinder 5.

The paper discharge unit 6 has a paper discharge cylinder provided with a sprocket 6*a* adjacent to the base impression cylinder 3. An endless chain 6*b* is mounted over the sprocket 6*a*, and a third gripper 13 is provided at the chain 6*b* for holding and discharging the printed sheet a' fed from the base impression cylinder 3. The sprocket 6*a* and the paper-feed cylinder 5 have diameters the same as those of the plate cylinders 1*a*, 2*a* and the blanket cylinders 1*b*, 2*b* of each of the first and second printing units 1, 2. Further, the diameters of the sprocket 6*a* and the paper-feed cylinder 5 are half the diameter of the base impression cylinder 3.

In operation, the paper "a" having been delivered from the paper supply unit 4 is subjected to pre-registration by the needle 9, and the paper "a" is then fed to the paper-feed cylinder 5 through the paper delivery means 4A and the paper insertion rollers 10. Upon arrival at the paper-feed cylinder 5, the leading edge of the paper "a" is gripped by the first gripper 11, and thence the paper "a" as gripped is transferred to the base impression cylinder 3 and is gripped by the second gripper 12. During that time, the paper "a" is printed with a first color at the first printing unit 1. The paper "a" is further fed to the second printing unit 2 where the paper "a" is additionally printed with a second color. The twice printed paper a' is discharged onto the chain 6*b* and is gripped by the third gripper 13. The paper a' is then transferred onto the paper discharge stand 8. Thus a cycle of two-color printing has been completed.

In such a printing machine provided with the paper-feed cylinder 5 in front of the base impression cylinder 3, according to the present invention, the paper-feed cylinder 5 is cocked, namely, a shaft 30 of the paper-feed cylinder 5 (FIGS. 1 through and 4) is swung with respect to the base impression cylinder 3 so that the paper "a" is gripped by the secong gripper 12 in a distorted or twisted posture.

Figure 4:
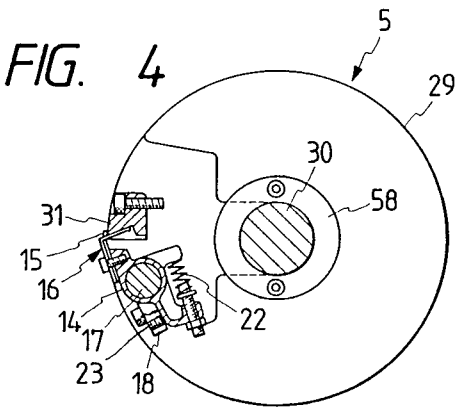
FIG. 4 is a cross-sectional view taken along the line IV—IV in FIG. 1.
Figure 3:
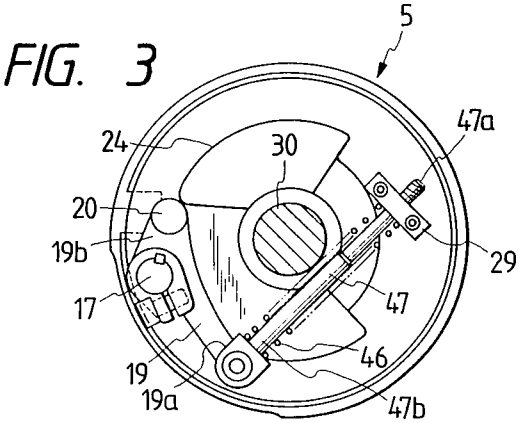
FIG. 3 is a cross-sectional view taken along the line III—III in FIG. 1.

This cocking mechanism will now be described in detail. as shown in FIGS. 1, 3 and 4, a plurality of grip holders 14 are rotatably mounted on a grip shaft 17 extending in parallel with the shaft 30 of the paper-feed cylinder 5, and their axial movements are prevented individually by a plurality of retainers 18 fixedly mounted on the grip shaft 17 by means of screw bolts 23 at suitable axial intervals. A grip 15 and a stop 16 are fixed to each of the grip holder 14.

As shown in FIGS. 1 and 3, a wheel 29 is fixedly provided at the shaft 30, and a cam lever 19 is fixed to one end of the grip shaft 17. One end 19*a* of the cam lever 19 is pivotally connected to one end 47*b* of a spring guide 47, and a coil spring 46 is disposed over the spring guide 47. Another end 47*a* of the spring guide 47 is slidably supported on the wheel 29. A cam follower 20 is rotatably connected to another end 19*b* of the cam lever 19. The cam follower 20 is engageable with a cam 24 fixed to a shaft holder 35 (FIGS. 1 and 2) by means of screw bolts. The shaft holder 35 is pivotally supported on the frame 21'. Upon movement of the cam follower 20 along the cam surface of the cam 24, the grip shaft 17 is rotated about its axis. Therefore, the individual grip holder 14 is pivotally moved about the axis of the grip shaft 17 by the corresponding retainer 18 via a spring 22 (FIG. 4) and the screw bolt 23 (FIGS. 1 and 4), thus closing and opening the individual grip 15.

The grip shaft 17, as shown in FIG. 1, is rotatably supported on a plurality of wheels 25, 26, 27, 28, 29 fixed to the shaft 30 of the paper-feed cylinder 5 at suitable axial intervals, and is directed in parallel with the shaft 30. A grip receiving member 31 (FIGS. 1 and 4) is fixedly supported by each of the wheels 25 through 29.

A pair of plates 59, 59 (FIGS. 1 and 4) fixed to the shaft 30 of the paper-feed cylinder 5 via a pair of collars 58, 58, respectively, serves as a paper guide.

The opposite ends of the shaft 30 of the paper-feed cylinder 5 are supported by first and second bearings 37, 60 (FIG. 1). The first and second bearings 37, 60 are supported by the frame 21 and the shaft holder 60, respectively, and are kept in position by a pair of bearing retainers 38, 62, respectively. Further, a bearing pressing member 36 is fixed to one end of the shaft 30 so as to retain an inner ring of the bearing 37 supported to the frame 21.

Most importantly, in the illustrated embodiment, the second bearing 60 is supported by the frame 21' through the the shaft holder 35, as shown in FIGS. 1 and 2, so that the paper-feed cylinder 5 can be cocked, namely, the paper feed-cylinde 5 is moved with respect to the impression cylinder 3 as shown in FIG. 5, to thereby distort or twist the paper "a". Thus the gripping manner of the second gripper 12 at the base impression cylinder 3 can be changed to regrip the paper "a" in such distorted or twisted posture, thereby enabling adjustment of the relationship between the paper "a" and an image to be printed thereon. For this, a hole 21'*a* is formed at the frame 21' so as to allow the shaft holder 35 to be pivotally movable about a pivot shaft 35*b* (described later). Therefore, by controlling the dimension of the hole 21'*a*, rocking movement of the shaft holder 35 is controlled, to thus control the cocking amount of the paper-feed cylinder 5 relative to the base impression cylinder 3.

As shown in FIGS. 1 and 2, the shaft holder 35 has a flange 35*a* projecting radially outwardly therefrom. At a base end portion of the flange 35*a*, the shaft holder 35 is pivotally supported on the frame 21' by a pivot shaft 35*b* implanted on the frame 21'. The pivot shaft 35*b* is disposed on an imaginary line l (FIGS. 2 and 6) connecting between the center of the shaft 30 of the paper-feed cylinder 5 and the center of the shaft 3*a* of the base impression cylinder 3. A nut 47 is threadingly engaged with the pivot shaft 35*b* so as to prevent the shaft holder 35 from removing from the frame 21'. Further, a screw bolt 35*d* is provided to avoid release of the shaft holder 35 from the frame 21'.

At free end portion of the flange 35*a*, a pin 49 is implanted, and a clevis 50 is pivotally connected to the pin 49, Thus by turning the shaft holder 35 about the pivot shaft 35*b*, it is possible to angularly move the second bearing 60 for adjustment of angular position of the shaft 30 of the paper-feed cylinder 5 with respect to the shaft 3*a* of the base impression cylinder 3.

As shown in FIG. 2, an operating shaft 52 has one end provided with a knob 51 for turning the shaft holder 35. The operating shaft 52 also has an externally threaded portion (hereinafter also referred to as "first male screw portion") 52*a* at a position near the knob 52, and another externally threaded portion (hereinafter also referred to as "second male screw portion") 52*b* at another end portion remote from the knob 52. The frame 21' has shaft retainer 53 having an internally threaded hole (hereinafter also referred to as "first female screw hole") 53*a* with which the first male screw portion 52*a* of the operating shaft 52 is threadingly engaged. Further, in FIG. 2, a spring retainer 55 is fixed to the frame 21', and a coil spring 54 is disposed in the retainer 55. The spring 54 serves to normally urge the shaft holder 35 toward the operating shaft 52, thereby preventing any play or rattle of the shaft holder 35. As the operating shaft 52 is turned in one or another direction by rotating the knob 51, the operating shaft 52 is moved axially forwardly and backwardly with respect to the frame 21' against the biasing force of the coil spring 54. The clevis 50 is formed with an internally threaded hole (hereinafter also referred to as "second female screw hole") 50*a* extending in axial direction thereof, so that the second male screw portion 52*b* is threadingly engaged with the second female screw hole 50*a*. In response to angular movement of the operating shaft 52, the clevis 50 is moved axially forwardly and backwardly relative to the operating shaft 52.

Spiral direction of these screws are all the same. However, the first male screw portion 52*a* and the first female screw hole 53*a* have a screw pitch greater than that of the second male screw portion 52*b* and the second female screw hole 50*a*. With this difference of the screw pitch, the relative movement between the clevis 50 and the operating shaft 52 can be reduced, even if the axial displacement of the shaft 52 relative to the frame 21' is large. Thus, the angular movement of the shaft holder 35 can be adjusted in a fine and delicate fashion by turning the knob 51.

For example, assuming that the first male screw portion 52*a* and the first female screw hole 53*a* have a screw pitch of 2 mm and the second male screw portion 52*b* and the second female screw hole 50*a* have a screw pitch of 1 mm, the operating shaft 52 can be axially moved by 2 mm upon a single complete rotation of the shaft 52. Meanwhile the clives 50 can be axially moved only by 1 mm, cancelling the 2 mm movement of the operating shaft 52 by 1 mm. As a result, the shaft holder 35 can be angularly moved about the pivot shaft 35*b* by only a small distance.

Although in the above described embodiment the operating shaft 52 is threadingly engaged with both the holder 53 of the frame 21' and the clevis 50, the present invention is not limited to such structure. For example, the operating shaft 52 can be only engaged with one of the holder 53 and the clevis 50, with the remaining one of the clevis 50 and the holder 53 being only provided at a given position. For example, if the operating shaft 52 is only threadingly engaged with the clevis 50, the holder 53 merely allows the shaft 52 to rotatably pass therethrough. Alternatively, if the operating shaft 52 is only threadingly engaged with the holder 53, the clevis 50 allows the shaft 52 to be rotatably received therein.

With the arrangement described above, when the master plate is erroneously assembled to the plate cylinder, for example, when the plate is slantingly attached to the plate cylinder, a paper can be easily distorted in conformance with the erroneous plate. That is, the shaft holder 35 is pivotally moved about the pivot shaft 35*b* positioned on the imaginary line connecting the central axes of the base impression cylinder 3 and the paper feed clyinder 5, by the rotational operation of the operation shaft 52. By this pivotal movement of the shaft holder 35, the paper-feed cylinder 5 is subjected to cocking with respect to the base impression cylinder 3, to thereby orient the paper in a proper direction. As a result, the second gripper 12 can grip the thus oriented paper. Such cocking is achievable with minized displacement of the paper-feed cylinder 5 with respect to the base-impression cylinder because of the pivotal movement of the shaft holder 35 abut the pivot shaft positioned at the imaginary line.

This is in high contrast to the conventional device wherein the plate cylinder is distorted. In the conventional device, roller pressure or plate pressure is not uniform over entire printing area, and printing quality may be varied dependent on printed positions. However, according to the present invention, it is possible to minimize any change in printing pressure that might occur between the central portion and the marginal portion of the paper-feed cylinder. Further, since the cocking of the paper-feed cylinder is performed by transmitting the rotation of the operating shaft to the shaft holder through the threaded portions formed on the operating shaft, a fine and hence delicate adjustment of the cocking can be achieved with maximum ease.

Further, in case of four-color printing, conventionally, images corresponding to third and fourth colors must be adjusted with respect to a paper prior to the adjustment of images corresponding to first and second colors. On the other hand, according to the present invention, only required is the adjustment of the first and second images with respect to the paper, and the image adjustment is achievable easily within a short time by mere rotation of the operation shaft 52, and such adjustment can be made even during operation of the printing machine. Furthermore, such adjustment is made by a simple mechanical construction with low cost.

Furthermore, in the present invention, since the bearing 60 is moved in an arcuate locus because of the pivotal movement of the shaft holder 35, change in distance between the axes of the base impression cylinder 3 and the paper-feed cylinder 5 is minimumly provided. This is in high contrast to the structure in U.S. Pat. No.

4,777,876. That is, the arcuate movement of the bearing 60 merely provide a small vertical displacement of the end portion of the shaft 30.

What is claimed is:

1. An apparatus for correcting a skew of an output image to be printed on a paper in a multi-color printing machine, comprising:

a frame;

a base impression cylinder rotatably supported on said frame and having a first shaft which has a first central axis;

a paper-feed cylinder for feeding the paper to said base impression cylinder, said paper-feed cylinder having a second shaft rotatably supported at opposite ends by said frame, said second shaft having a second central axis;

a shaft holder for holding one end of said second shaft of said paper-feed cylinder and having first and second end portions, said shaft holder being pivotally supported to said frame at said first end portion;

a pivot shaft for pivotally supporting said first end portion of said shaft holder, said pivot shaft extending from said frame and disposed on an imaginary line extending between said axes of said first and second shafts;

an operating shaft rotatably supported on said frame and operatively connected to said second end portion of said shaft holder; and means for pivoting said shaft holder about said pivot shaft in response to rotation of said operating shaft, said means being disposed between said operating shaft and at least one of said frame and said shaft holder.

2. The apparatus as defined in claim 1, wherein said means for pivoting comprises a first threading portion (53*a*) provided at said frame and a second threading portion (52*a*) formed over one end portion of said operating shaft, said first threading portion being threadingly engaged with said second threading portion.

3. The apparatus as defined in claim 1, wherein said means for pivoting comprises a clevis (50) connected to said second end portion of said shaft holder, said clevis being formed with one threading portion (50*a*); and another threading portion (52*b*) formed over an end portion of said operating shaft, said one threading portion being threadingly engaged with said another threading portion.

4. The apparatus as defined in claim 2, wherein said means for pivoting further comprises a clevis connected to said second end portion of said shaft holder, said clevis being formed with a third threading portion (50*a*); and a fourth threading portion (52*b*) formed over another end portion of said operating shaft, said first and second threading portions having spiral pitches twice as large as those of said third and fourth threading portions.

5. The apparatus as defined in claim 2, wherein said means for pivoting further comprises an operation knob connected to one end of said operating shaft, said second threading portion being positioned adjacent said operation knob.

6. The apparatus as defined in claim 3, wherein said means for pivoting further comprises an operation knob connected to one end of said operating shaft, said fourth threading portion being positioned remote from said operation knob.

7. The apparatus as defined in claim 4, wherein said means for pivoting further comprises an operation knob connected to one end of said operating shaft, said fourth threading portion being positioned remote from said operation knob.

8. The apparatus as defined in claim 1, further comprising a first gripper means provided on said paper-feed cylinder for selectively gripping said paper.

9. The apparatus as defined in claim 8, further comprising a second gripper means provided on said base impression cylinder for selectively gripping said paper fed from said paper-feed cylinder.

* * * * *